US010827897B2

(12) United States Patent
Li et al.

(10) Patent No.: US 10,827,897 B2
(45) Date of Patent: Nov. 10, 2020

(54) CLEANING TOOL

(71) Applicant: Jiaxing Jackson Travel Products Co., Ltd., Jiaxing (CN)

(72) Inventors: Jing Li, Jiaxing (CN); Hao Chen, Jiaxing (CN); Minfeng Wang, Jiaxing (CN); Xuan Li, Jiaxing (CN)

(73) Assignee: Jiaxing Jackson Travel Products Co., Ltd., Jiaxing (CN)

( * ) Notice: Subject to any disclaimer, the term of this patent is extended or adjusted under 35 U.S.C. 154(b) by 117 days.

(21) Appl. No.: 16/015,558

(22) Filed: Jun. 22, 2018

(65) Prior Publication Data

US 2019/0090714 A1 Mar. 28, 2019

Related U.S. Application Data

(63) Continuation-in-part of application No. PCT/CN2017/097774, filed on Aug. 17, 2017.

(30) Foreign Application Priority Data

Aug. 31, 2016 (CN) ..... 2016 2 1033527 U
Dec. 16, 2016 (CN) ..... 2016 2 1385390 U
(Continued)

(51) Int. Cl.
*A47L 11/33* (2006.01)
*A47L 13/44* (2006.01)
(Continued)

(52) U.S. Cl.
CPC ..... *A47L 11/33* (2013.01); *A47L 11/22* (2013.01); *A47L 11/4036* (2013.01); *A47L 13/44* (2013.01)

(58) Field of Classification Search
CPC ..... A47L 11/22; A47L 11/24; A47L 11/32; A47L 11/33; A47L 11/40; A47L 11/4036; A47L 13/44
(Continued)

(56) References Cited

U.S. PATENT DOCUMENTS 4,369,539 A * 1/1983 Nordeen ..... A47L 11/33 15/41.1
8,495,781 B2 * 7/2013 Dingert ..... A47L 11/22 15/320
(Continued)

FOREIGN PATENT DOCUMENTS

JP 2003-320322 * 11/2003
WO 2005/087075 * 9/2005

*Primary Examiner* — Mark Spisich
(74) *Attorney, Agent, or Firm* — Thomas | Horstemeyer LLP

(57) ABSTRACT

The present invention provides a cleaning tool, comprising a hand-push sweeper, wherein the hand-push sweeper comprising a case with a garbage storage space and a garbage inlet; a sweeping roller that rotates with the hand-push sweeper; garbage can be swept into the case when the sweeping roller rotates; and a push rod that connects the case; a shovel blade at the opening of the garbage storage space; the shovel blade comprises a flexible scraper and a mounting base, and the flexible scraper is fixed with the mounting base Connecting, the mounting base is integrated onto the case, and the flexible scraper forms an obtuse angle with the ground on the forward side; the cleaning tool further comprising a mop plate that is removably connected to the hand-push sweeper, the lower portion of the mop plate is connected with the mop cloth; when the mop plate is connected to the hand-push sweeper, the mop plate disengages the sweep roller from the ground; when the mop plate is separated from the hand-push sweeper, the sweep roller is in contact with the ground.

18 Claims, 8 Drawing Sheets

(30) Foreign Application Priority Data

Jul. 4, 2017 (CN) ..... 2017 2 0796664 U
Aug. 11, 2017 (CN) ..... 2017 2 0999884 U

(51) Int. Cl.
*A47L 11/22* (2006.01)
*A47L 11/40* (2006.01)

(58) Field of Classification Search
USPC ..... 15/4, 41.1, 44, 52.1, 98, 247
See application file for complete search history.

(56) References Cited

U.S. PATENT DOCUMENTS

2009/0100636 A1* 4/2009 Sohn ..... A47L 5/32
15/368
2014/0026344 A1* 1/2014 Bradbury ..... A47L 13/44
15/231

* cited by examiner

CLEANING TOOL

RELATED APPLICATIONS

This application claims priority to Chinese patent application serial no. 201720999884.5 filed Aug. 11, 2017 and Chinese patent application serial no. 2017207966642, filed Jul. 4, 2017. This application is also a continuation in part of International application serial no. PCT/CN2017/097774, filed Aug. 17, 2017. International application serial no. PCT/CN2017/097774 claims the benefit of Chinese application serial no. 201621033527.5, filed Aug. 31, 2016; Chinese application serial no. 201621385390.X, filed Dec. 16, 2016; and Chinese application serial no. 201720999884.5, filed Aug. 11, 2017. The entire contents of each of the above-referenced applications are incorporated herein by reference.

FIELD OF THE INVENTION

This utility model relates to a cleaning tool, and more particularly, to a cleaning tool that can be used for mopping and collecting garbage.

BACKGROUND

Chinese patent CN204274351U discloses a sweeper which is easy to assemble and clean. The wheels are rotatably connected at the bottom of case, and the wheels communicate with outside of the case; when mopping, the wheels are in contact with the ground. The rolling wheels are placed horizontally and fixed with the wheels. A card slot is disposed axially on the surface of the rolling wheel; and the mop is disposed at both sides of the bottom of the case.

The aforesaid invention has integrated the functions of mopping and garbage collection, but the mopping and garbage collection functions cannot achieve rapid separation. Therefore, the above technical solution has the problem of discontinuous distribution of mop cloth, so it has a poor moping effect and a small cleaning area. The mop cloth and garbage collection cannot be separated quickly. Sometimes, when only the garbage collection function is required, mopping is carried out by a mop cloth. Therefore, the mop cloth is extremely easy to be soiled, with a poor overall convenience during use.

SUMMARY

The object of this utility model is to overcome the above shortcomings in the prior art and provide a cleaning tool that has reasonable structure design and is easy to operate.

One of the aspects of this invention, here provide a cleaning tool comprising: a case, the said case comprising a garbage storage space and a opening for receiving the garbage; a push rod, the said push rod is rotatably connected with the case; a sweeping roller rotating with the case as to swept garbage into the garbage storage space when the sweeping roller rotates; wherein the cleaning tool comprising a mop plate that is removably connected to the hand-push sweeper by a removably connection means, wherein, when the mop plate is connected to the hand-push sweeper, the mop plate disengages the sweeping roller from the ground; when the mop plate is separated from the hand-push sweeper, the sweeping roller is in contact with the ground.

In one of embodiments, the removable connection means comprises a vertical connecting mechanism and/or a horizontal connection structure, the case and the mop plate are limited by a horizontal connection structure in the front and back, left and right; and/or the case is vertically movably assembled with the mop plate by a vertical connecting mechanism.

In one of embodiments, the vertical connecting mechanism comprises a magnet, and the case and the mop plate are magnetized.

In one of embodiments, the vertical connecting mechanism comprises a hook and a corresponding card slot.

In one of embodiments, the vertical connecting mechanism comprises an elastic operation member and a buckle.

In one of embodiments, the vertical connecting mechanism comprises a convex portion disposed on the case, a concave portion disposed on the mop plate, and the convex portion is embedded in the concave portion to assemble removably the hand-push sweeper with the mop plate.

In one of embodiments, the horizontal connection structure comprises a recessed position disposed on the mop plate, and the case of the hand-push sweeper is disposed in the recessed position.

In one of embodiments, the horizontal connection structure comprises a protruding position disposed on the mop plate, a hole disposed at the bottom of the case, and the protruding position is embedded in the hole when the hand-push sweeper is connected to the mop plate.

In one of embodiments, the case of the hand-push sweeper is in interference fit with the recessed position on the mop plate.

In one of embodiments, the protruding position is in interference fit with the recessed position.

In one of embodiments, further comprising an adjustment mechanism that incline the opening of case upwards when the push rod is tilted, and wherein the push rod is flexibly connected with the case, and the adjustment mechanism is disposed at the pivotal connection between the push rod and the case.

In one of embodiments, said flexibly connection is rotatably connection.

In one of embodiments, wherein the adjustment mechanism is a torsion spring, the push rod is rotationally connected with the case using a universal joint, and the universal joint comprises an upper joint, a lower joint, and one end of the upper joint is rotatably connected with one end of the lower joint, and the other end of the lower joint is rotatably connected with the mop plate, another end of the upper joint is fixedly installed with the push rod; one end of the torsion spring exerts force on the mop plate, and the other end of the torsion spring exerts force on the lower joint.

In one of embodiments, further comprising a latching mechanism for preventing the sweeping roller from reversing, the latching mechanism comprises a sweeping roller having a movable stroke space after being set in the mounting portion, a locking mechanism disposed between the sweeping roller and the machine body, when the sweeper sweeps forward, the sweeping roller moves to the rear end of the stroke space; when the sweeper retreats, the sweeping roller moves to the front end of the stroke space, the locking mechanism prevents the sweeping roller from rotating.

In one of embodiments, the sweeping roller comprises a rotating shaft, and the rotating shaft comprising a sweeping strip.

In one of embodiments, the locking mechanism comprises a convex body, a concave body, the convex body and the concave body are respectively disposed on the case and the sweeping roller, and when the sweeping roller moves to the front end of the stroke space, the convex body is embedded in the concave body to prevent the sweeping roller from rotating.

In one of embodiments, the sweeping strip rotates to the garbage entry position when the locking mechanism prevents the sweeping roller from rotating.

In one of embodiments, the locking mechanism comprises a convex body, a concave body, the convex body and the concave body are respectively disposed on the case and the sweeping roller, and when the sweeping roller moves to the front end of the stroke space, the convex body is embedded in the concave body to prevent the sweeping roller from rotating, when the locking mechanism prevents the sweeping roller from rotating, the sweeping strip rotates to the garbage entry position.

In other aspects, the present utility model adopts the following technical solutions: a cleaning tool, comprising a hand-push sweeper, wherein the hand-push sweeper comprising a case with a garbage storage space and a garbage inlet; a sweeping roller that rotates with the hand-push sweeper; garbage can be swept into the case when the sweeping roller rotates; and a push rod that connects the case; a shovel blade at the opening of the garbage storage space; the shovel blade comprises a flexible scraper and a mounting base, and the flexible scraper is fixed with the mounting base Connecting, the mounting base is integrated onto the case, and the flexible scraper forms an obtuse angle with the ground on the forward side; the cleaning tool further comprising a mop plate that is removably connected to the hand-push sweeper, the lower portion of the mop plate is connected with the mop cloth; when the mop plate is connected to the hand-push sweeper, the mop plate disengages the sweep roller from the ground; when the mop plate is separated from the hand-push sweeper, the sweep roller is in contact with the ground.

Further, the removable connection comprises a vertical connecting mechanism and a horizontal connection structure, the hand-push sweeper and the mop plate are limited by a horizontal connection structure in the front and back, left and right; the hand-push sweeper is vertically movably assembled with the mop plate by a vertical connecting mechanism.

Further, the vertical connecting mechanism comprises a magnet, and the hand-push sweeper and the mop plate are magnetized.

Further, the vertical connecting mechanism comprises a hook disposed on the mop plate and a corresponding card slot disposed on the hand-push sweeper.

Further, the vertical connecting mechanism comprises an elastic operation member and a buckle, and the elastic operation member and the buckle are respectively arranged on the hand-push sweeper and the mop plate, the elastic operating member defines a buckle.

Further, the vertical connecting mechanism comprises a convex portion disposed on the case of hand-push sweeper, a concave portion disposed on the mop plate, and the convex portion is embedded in the concave portion to assemble and connect the hand-push sweeper with the mop plate.

Further, the horizontal connection structure comprises a recessed position disposed above the mop plate, and the case of the hand-push sweeper is disposed in the recessed position.

Further, the horizontal connection structure comprises a protruding position disposed above the mop plate, a hole disposed at the bottom of the case of the hand-push sweeper, and the protruding position is embedded in the hole when the hand-push sweeper is connected to the mop plate.

Further, the case of the hand-push sweeper is in interference fit with the recessed position above the mop plate.

Further, the protruding position is in interference fit with the recessed position.

Further, further comprising an adjustment mechanism with the garbage inlet of the case inclined upwards when the push rod is tilted, wherein the push rod is rotatably connected with the case, and the adjustment mechanism is disposed at the pivotal connection between the push rod and the case.

Further, the adjustment mechanism is a torsion spring, the push rod is rotationally connected with the case using a universal joint, and the universal joint comprises an upper joint, a lower joint, and one end of the upper joint is rotatably connected with one end of the lower joint, and the other end of the lower joint is rotatably connected with the mop plate, another end of the upper joint is fixedly installed with the push rod; one end of the torsion spring exerts force on the mop plate, and the other end of the torsion spring exerts force on the lower joint.

Further, comprising a latching mechanism for preventing the sweeping roller from reversing, the latching mechanism comprises a sweeping roller having a movable stroke space after being set in the mounting portion, a locking mechanism disposed between the sweeping roller and the machine body, when the sweeper sweeps forward, the sweeping roller moves to the rear end of the stroke space; when the sweeper retreats, the sweeping roller moves to the front end of the stroke space, the locking mechanism prevents the sweeping roller from rotating.

Further, the sweeping roller comprises a rotating shaft, a sweeping strip, and a rolling wheel, the rotating shaft is provided with sweeping strip, the rolling wheel is disposed at both end of the rotating shaft, the rolling wheel is provided with a rolling shaft, and the rolling shaft is disposed at the mounting portion.

Further, the locking mechanism comprises a convex body, a concave body, the convex body and the concave body are respectively disposed on the case and the sweeping roller, and when the sweeping roller moves to the front end of the stroke space, the convex body is embedded in the concave body to prevent the sweeping roller from rotating.

Further, the locking mechanism rotates to the garbage entry position when the locking mechanism prevents the sweeping roller from rotating.

Further, the locking mechanism comprises a convex body, a concave body, the convex body and the concave body are respectively disposed on the case and the sweeping roller, and when the sweeping roller moves to the front end of the stroke space, the convex body is embedded in the concave body to prevent the sweeping roller from rotating, when the locking mechanism prevents the sweeping roller from rotating, the sweeping strip rotates to the garbage entry position.

Compared with prior art, this utility model has the following advantages and effects. This utility model has a simple and reasonable structure design. This tool has the functions of mopping and garbage collecting; when cleaning, the two functions are combined effectively, to facilitate the operation.

DETAILED DESCRIPTION

The present utility model will be further described in detail with reference to the accompanying drawings and embodiments. The following embodiments are intended to explain the present utility model but not limited to the following embodiments.

Example 1

Figure 1:
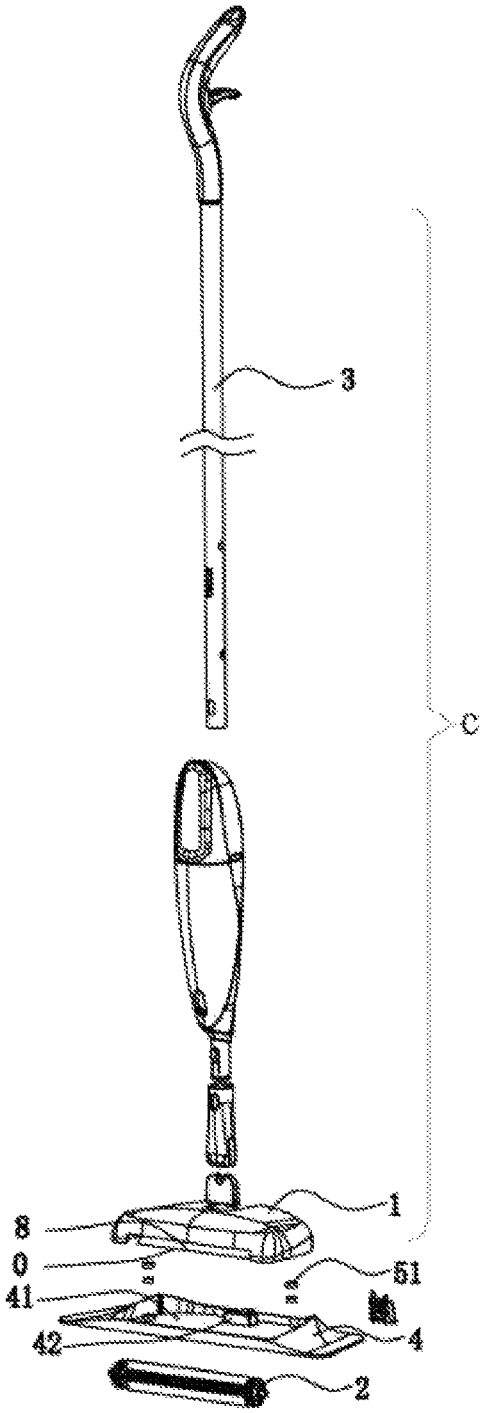
FIG. 1 is a schematic structural view of an exploded state of the present utility model.
Figure 2:
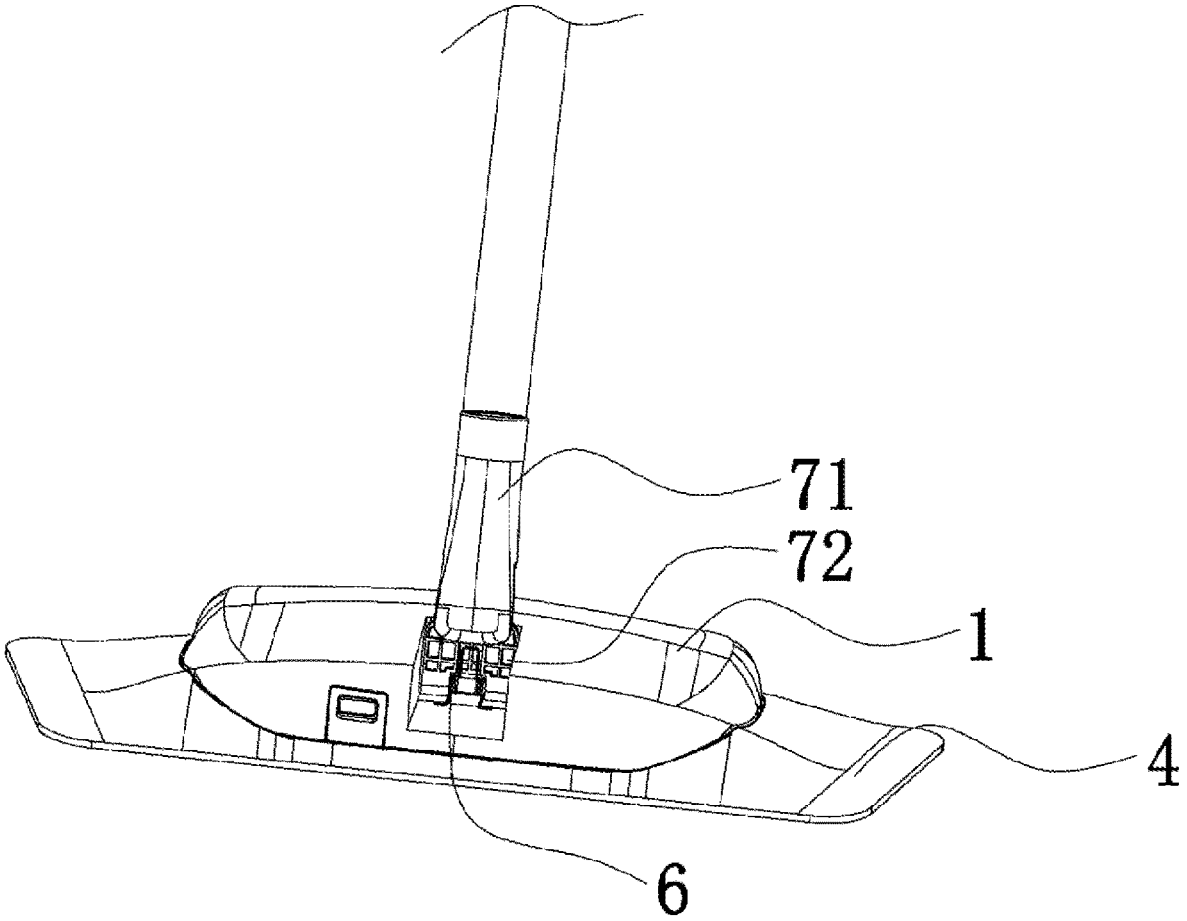
FIG. 2 is a schematic structural view of a combined state of the present utility model.
Figure 3:
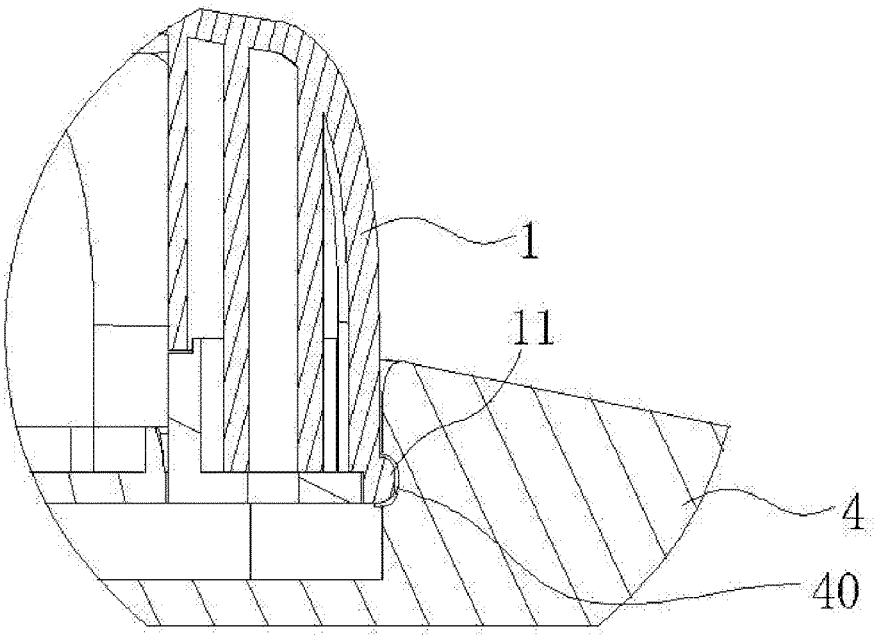
FIG. 3 is a schematic structural view of one of the specific embodiments of the removable connection according to the present utility model.

Referring to FIG. 1 and FIG. 2, a cleaning tool described in this embodiment comprising a hand-push sweeper c. the hand-push sweeper c comprising a case 1 with a garbage storage space and a garbage inlet 0. The garbage inlet 0 is provided with a sweeping roller 2 which is pushed by the hand-push sweeper c; a push rod 3 connected to the case 1; a shovel blade 8 provided at the garbage inlet 0; the shovel blade 8 comprises a flexible scraper and a mounting base. The flexible scraper is fixedly connected with the mounting base. As a preferred example, the flexible scraper is made of a flexible PVC material, the mounting base is made of a rigid PVC material, the mounting base of the shovel blade 8 is fixedly connected with the case 1, and when the floor is cleaned, the flexible scraper scrapes the ground. Because the flexible scraper is flexible, it can be closely fitted to the ground. When the flexible scraper meets uneven bricks, it can also be deformed and avoided, which is more reliable than hard scraping. Excessive hard scraping may cause damage to the shovel blade 8. The flexible scraper forms an obtuse angle with the ground on the forward side; the cleaning tool further comprises a mop plate 4 and a cloth under the mop plate 4; When the mop plate 4 is connected to the hand-push sweeper c, the mop plate 4 is disposed below the hand-push sweeper c to block the hand-push sweeper c from the ground, and the hand-push sweeper c is obstructed by the mop plate 4 and cannot be used as a collecting garbage sweeper. The cleaning tool can only be used as a mop; when the mop plate 4 is separated from the hand-push sweeper c, the cleaning tool is used as a hand-push sweeper c. The sweeping roller 2 is in contact with the ground. The cleaning tool described in this embodiment can be used both as a mop and a sweeper. When the floor is dragged, a large amount of garbage is collected. Then it is convenient to remove ground garbage with a sweeper.

The removable connection described in this embodiment comprises a vertical connecting mechanism and a horizontal connection structure, the hand-push sweeper and the mop plate 4 are limited by a horizontal connection structure in the front and back, left and right; when mopping, the direction of force is forward, backward, left and right, and the horizontal connection structure positions the hand-push sweeper and the mop plate 4 in the front, rear, left, and right directions. The hand-push sweeper is vertically movably assembled with the mop plate 4 by a vertical connecting mechanism. The hand-push sweeper and the mop plate 4 can be integrally connected; when using the hand-push sweeper, the hand-push sweeper is split with the mop plate 4.

One implementation manner of the vertical connecting mechanism according to this embodiment is: the vertical connecting mechanism comprises a magnet 51, and the magnets 51 are oppositely disposed on the hand-push sweeper and the mop plate 4 respectively, and the hand-push sweeper and the mop plate are magnetized by a magnet 51. The opposite magnet 51 can be implemented to achieve the magnetization of the hand-push sweeper and the mop plate 4 using an iron block corresponding to the magnet.

Another implementation manner of the vertical connecting mechanism according to this embodiment is: the vertical connecting mechanism comprises a convex portion 11 disposed on the case 1 of hand-push sweeper, a concave portion 40 disposed on the mop plate 4, and the convex portion 11 is embedded in the concave portion 40 to assemble and connect the hand-push sweeper with the mop plate 4.

Figure 4:
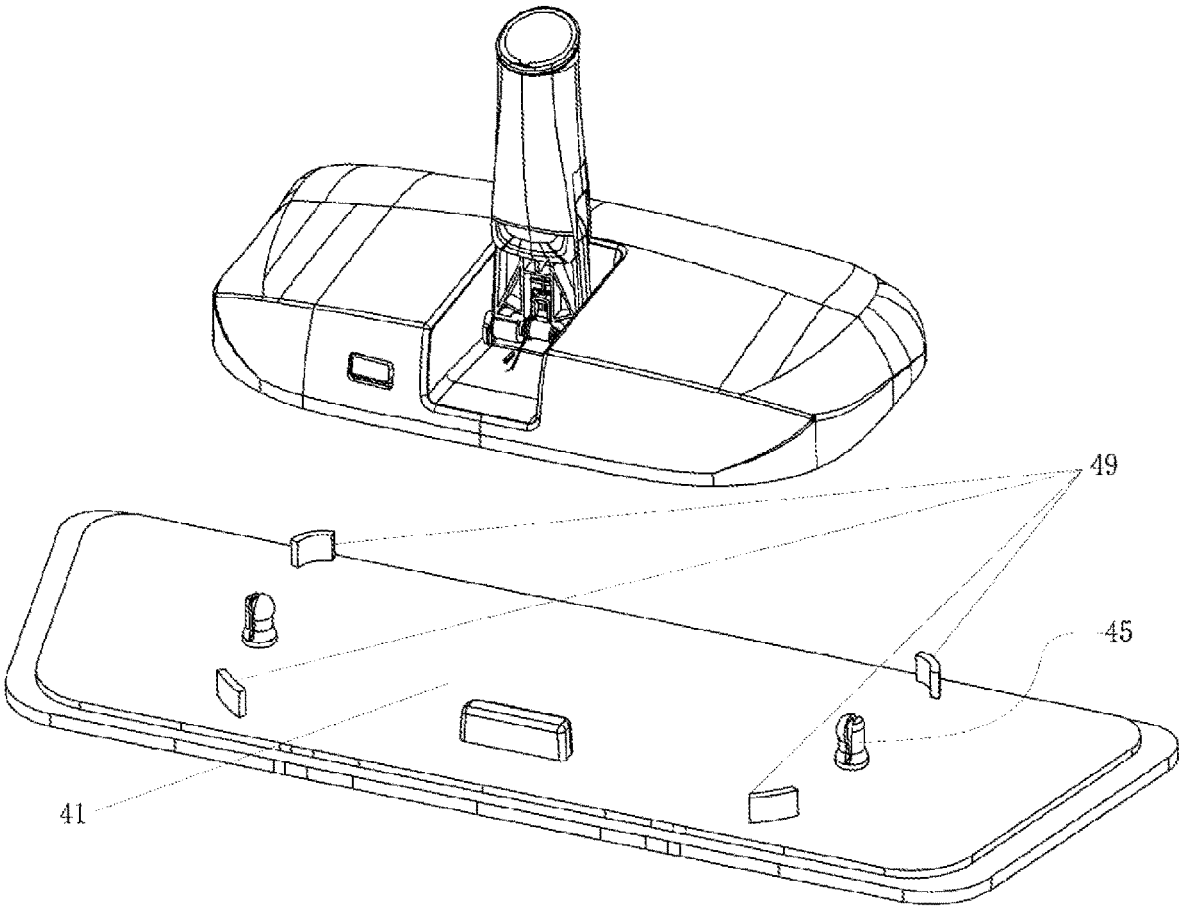
FIG. 4 is a schematic structural diagram of a second specific implementation of the removable connection according to the present utility model.
Figure 5:
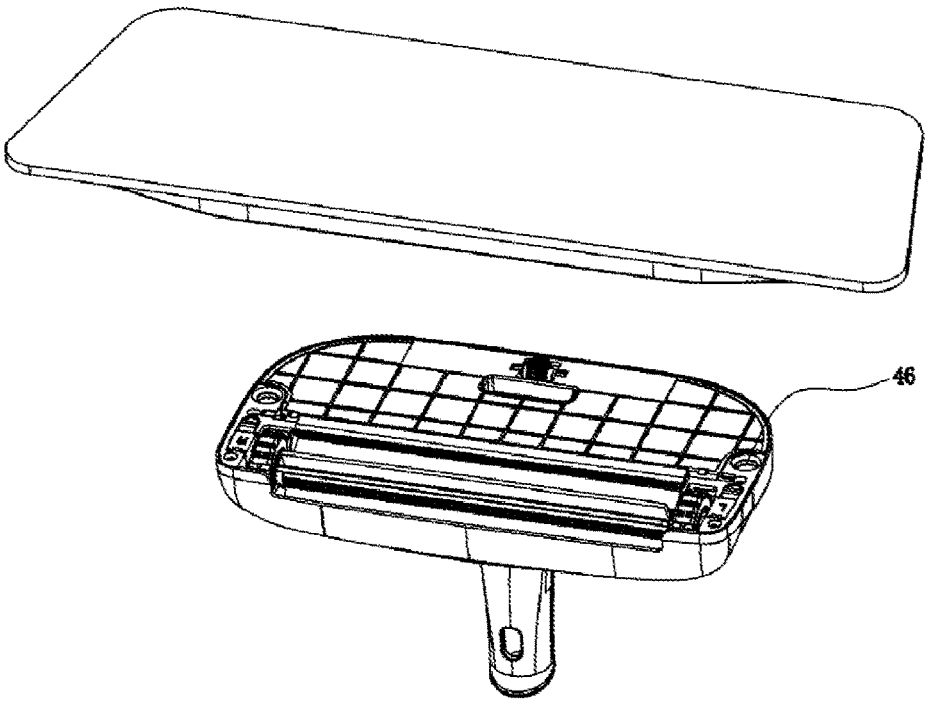
FIG. 5 is a schematic structural view of FIG. 4 from another perspective.

Referring to FIGS. 4 and 5, another embodiment of the vertical connecting mechanism according to this embodiment is that: the vertical connecting mechanism comprises a hook 45 disposed on a mop plate 4 and a corresponding card slot 46 disposed on the hand-push sweeper c. The hook 45 or the corresponding card slot 46 can be deformed, and the hook 45 is engaged with corresponding card slot 46 by interference.

Figure 6:
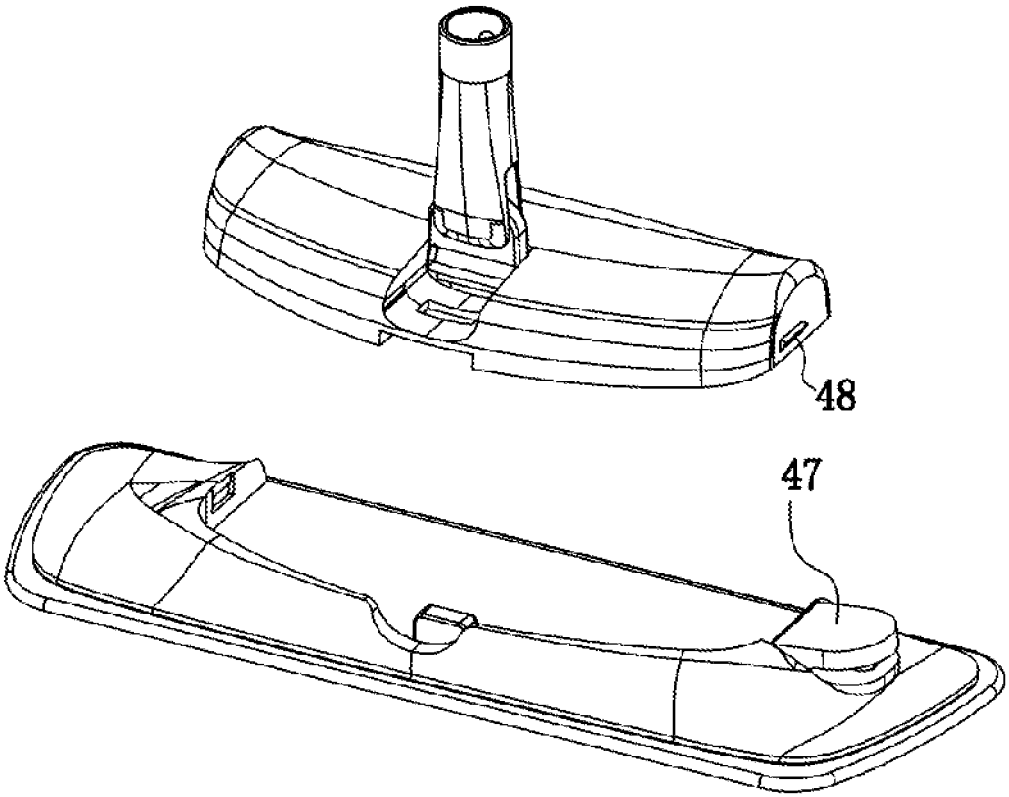
FIG. 6 is a schematic structural view of a third embodiment of the removable connection according to the present invention.

Referring to FIG. 6, another embodiment of the vertical connecting mechanism according to this embodiment is that: the vertical connecting mechanism comprises an elastic operation member 47 and a buckle 48, and the elastic operation member 47 and the buckle 48 are respectively set in the hand-push sweeper c and the mop plate, the elastic operation member 47 defines the buckle 48. The elastic operation member 47 can rely on its own elasticity, and can also make the operation member elastic by introducing a torsion spring and other elastic bodies. Specifically, in this embodiment, the case is provided with a relatively convex buckle 48, and the elastic operation member 47 in the mop plate, the elastic operation member 47 presses the buckle 48 so as to realize the combination of the hand-push sweeper c and the mop plate 4. An external force is applied to the elastic operation member 47, and the hand-push sweeper c is lifted, and the hand-push sweeper c can be separated from the mop plate 4.

Figure 7:
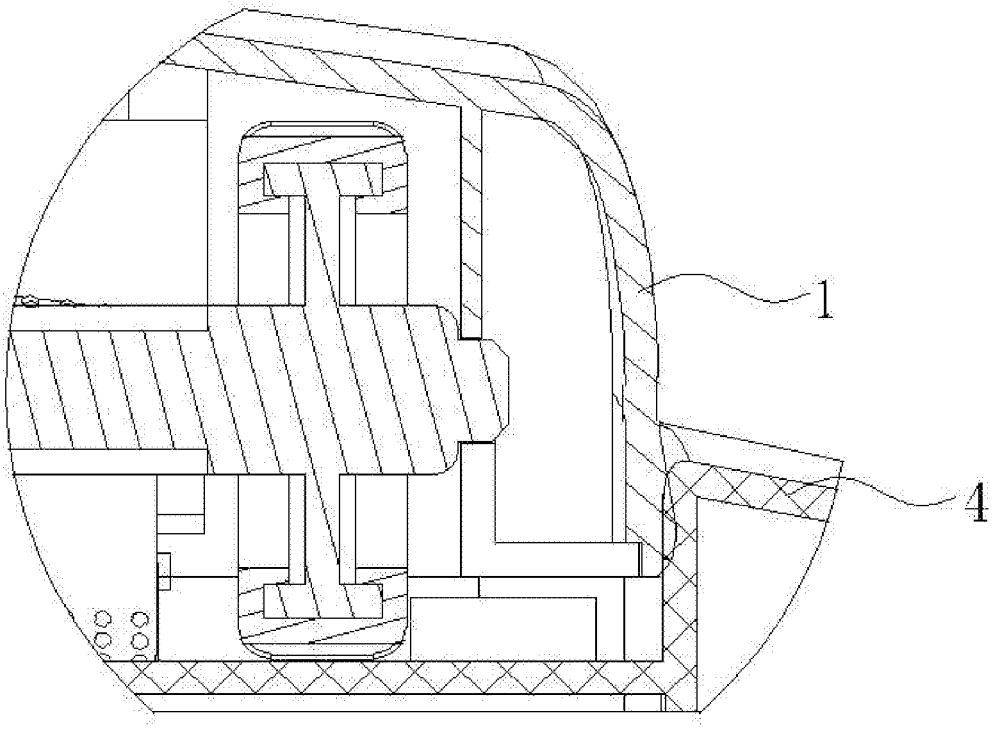
FIG. 7 is a schematic structural diagram of a fourth embodiment of the removable connection according to the present invention.

Referring to FIG. 7, one implementation manner of the horizontal connection structure according to this embodiment is: the horizontal connection structure comprises a recessed position 41 disposed above the mop plate, and the case 1 of the hand-push sweeper is disposed in the recessed position 41. The horizontal connection structure mentioned above can be implemented in conjunction with the following vertical connecting mechanism. The case 1 of the hand-push sweeper in this embodiment is in interference fit with the recessed position 41 above the mop plate 4.

The concave position 41 in this embodiment refers to a cofferdam state formed by the hand-push sweeper c when the hand-push sweeper c is combined with the mop plate 4, and the cofferdam states include a closed type and a discrete open type. Referring to FIG. 2, for example, formed in the closed low-lying portion of the mop plate 4, Referring to FIG. 4, a constrained region formed by discretely distributed stoppers 49.

Another implementation manner of the horizontal connection structure according to this embodiment is: the horizontal connection structure comprises a protruding position 42 disposed above the mop plate 4, a hole disposed at the bottom of the case 1 of the hand-push sweeper, and the protruding position 42 is embedded in the hole when the hand-push sweeper is connected to the mop plate 4. The above horizontal connection structure can be implemented in combination with the following vertical connecting mechanism, and the protruding position 42 is in interference fit with the hole.

This embodiment further comprising an adjustment mechanism with the garbage inlet of the case 1 inclined upwards when the push rod 3 is tilted, wherein the push rod 3 is rotatably connected with the case 1, and the adjustment mechanism is disposed at the pivotal connection between the push rod 3 and the case 1.

Referring to FIG. 2, the adjustment mechanism described in this embodiment is a torsion spring 6, the push rod 3 is rotationally connected with the case 1 using a universal joint, and the universal joint comprises an upper joint 71, a lower joint 72, and one end of the upper joint 71 is rotatably connected with one end of the lower joint 72, and the other end of the lower joint 72 is rotatably connected with the case 1, another end of the upper joint 71 is fixedly installed with the push rod 3; one end of the torsion spring 6 exerts force on the case 1, and the other end of the torsion spring 6 exerts force on the lower joint 72. The push rod 3 is elastically connected with the case 1 of the hand-push sweeper by a torsion spring 6, when the cleaning tool is tilted off the ground, the garbage inlet of case 1 is also tilted upwards to prevent the garbage in case 1 from falling from the trash inlet; during cleaning, the mop plate 4 or case 1 is attached to the ground, and the push rod 3 can overcome the elastic force of the torsion spring 6 to tilt. Its cleaning convenience is not affected by the torsion spring 6.

Figure 8:
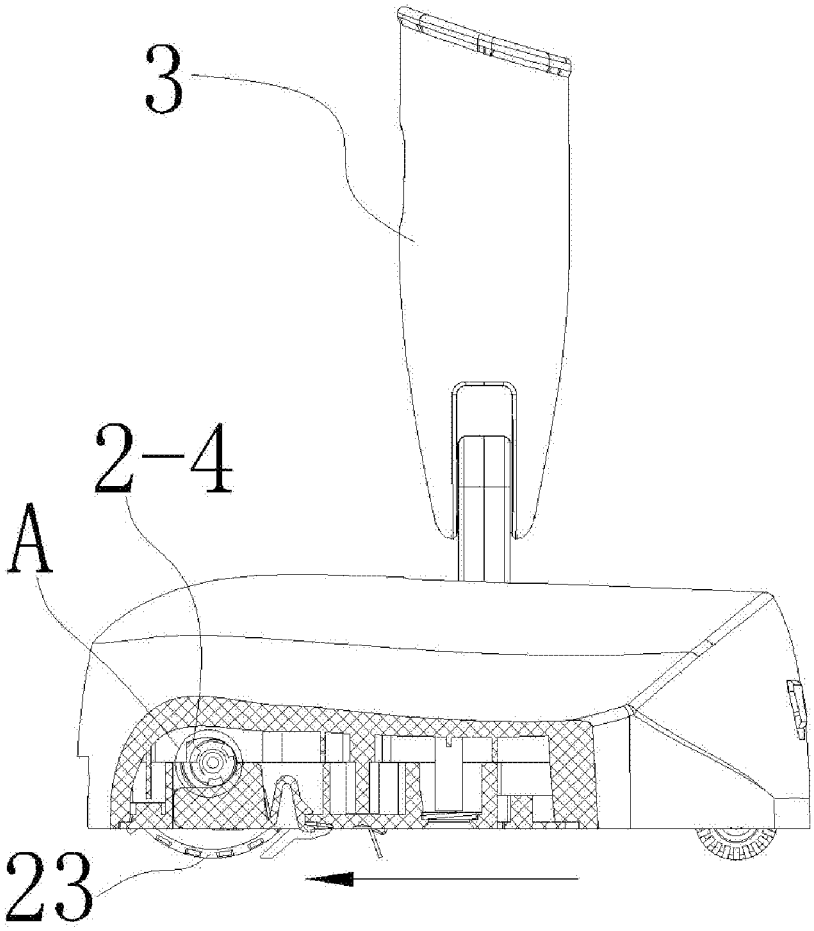
FIG. 8 is a schematic structural view of the present utility model in a retracted state.
Figure 9:
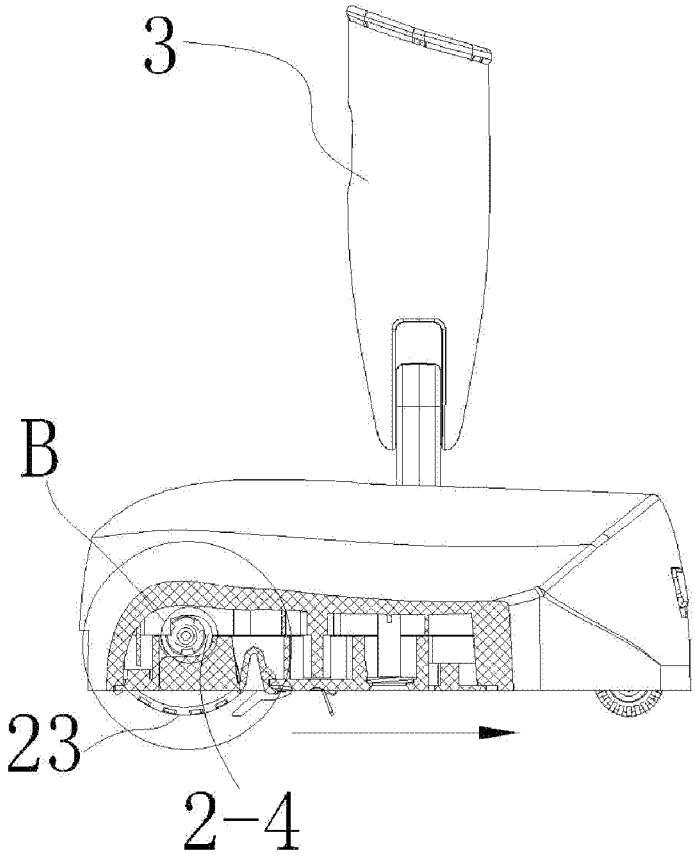
FIG. 9 is a schematic structural view of a sweeping roller according to the present utility model.

Referring to FIG. 8 and FIG. 9, This utility model further comprises a latching mechanism for preventing the sweeping roller 2 from reversing, the latching mechanism comprises a sweeping roller 2 having a movable stroke space 2-4 after being set in the mounting portion, preferably, the stroke space 2-4 is a long cavity with a mounting portion. The latching mechanism further comprises a locking mechanism disposed between the sweeping roller 2 and the case 1, when the sweeper sweeps forward, the sweeping roller 2 moves to the rear end of the stroke space 2-4; when the sweeper retreats, the sweeping roller 2 moves to the front end of the stroke space 2-4, the locking mechanism prevents the sweeping roller 2 from rotating. Preferably, the locking mechanism comprises a convex body 2-5 and a concave body 2-6, wherein the convex body 2-5 and the concave body 2-6 are respectively disposed on the case 1 and the sweeping roller 2, and when the sweeping roller 2 moves to the front end of the stroke space 2-4, the convex body 2-5 is embedded in the concave body 2-6 to prevent the sweeping roller 2 from rotating.

Figure 10:
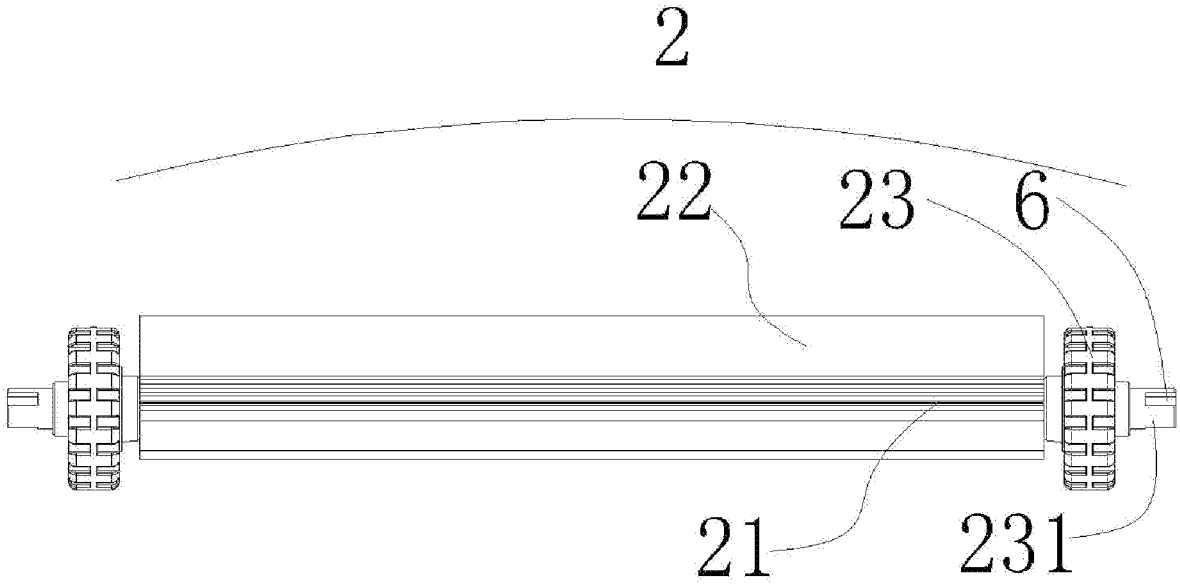
FIG. 10 is a partially enlarged view of the portion A shown in FIG. 8.

Referring to FIG. 10, the sweeping roller 2 described in this embodiment comprises a rotating shaft 21, a sweeping strip 22, and a rolling wheel 23, the rotating shaft 21 is fixedly provided with a sweeping strip 22, the rolling wheel 23 is disposed at both end of the rotating shaft 21. The rolling wheel 23 is provided with a rolling shaft 231, and the rolling shaft 231 is disposed at the mounting portion.

When the locking mechanism described in this embodiment prevents sweeping roller 2 from rotating, preferably, the convex body 2-5 is embedded in the concave body 2-6 to prevent the rotation of sweeping roller 2. At this time, the sweeping strip 22 stays at the garbage entry position and the sweeping strip 22 prevents garbage from leakage due to reflow from the entry.

Figure 11:
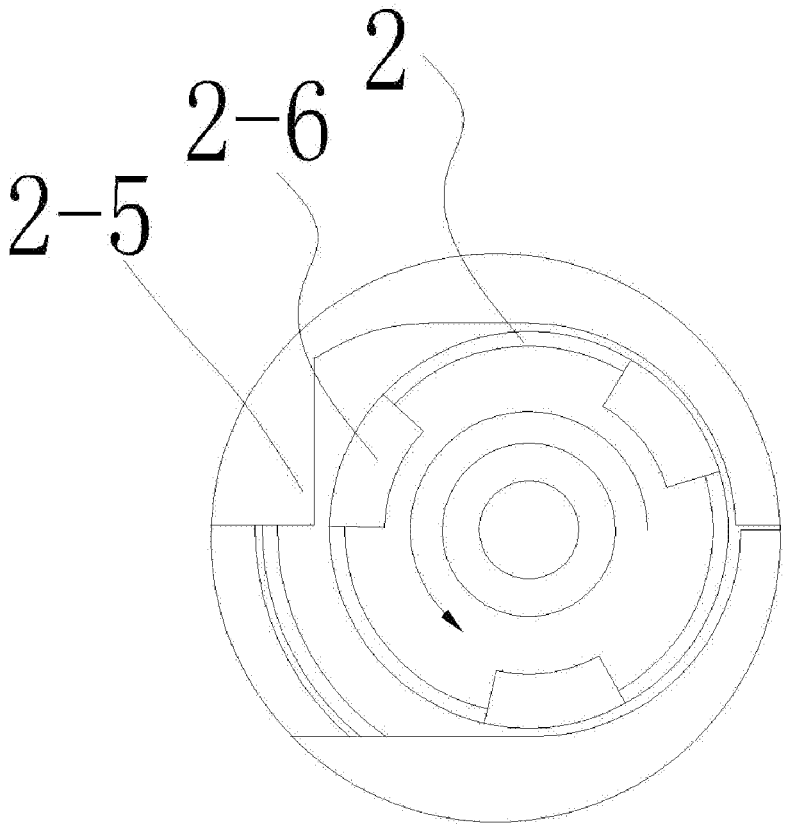
FIG. 11 is a partially enlarged view of the portion B shown in FIG. 9 (first status).
Figure 12:
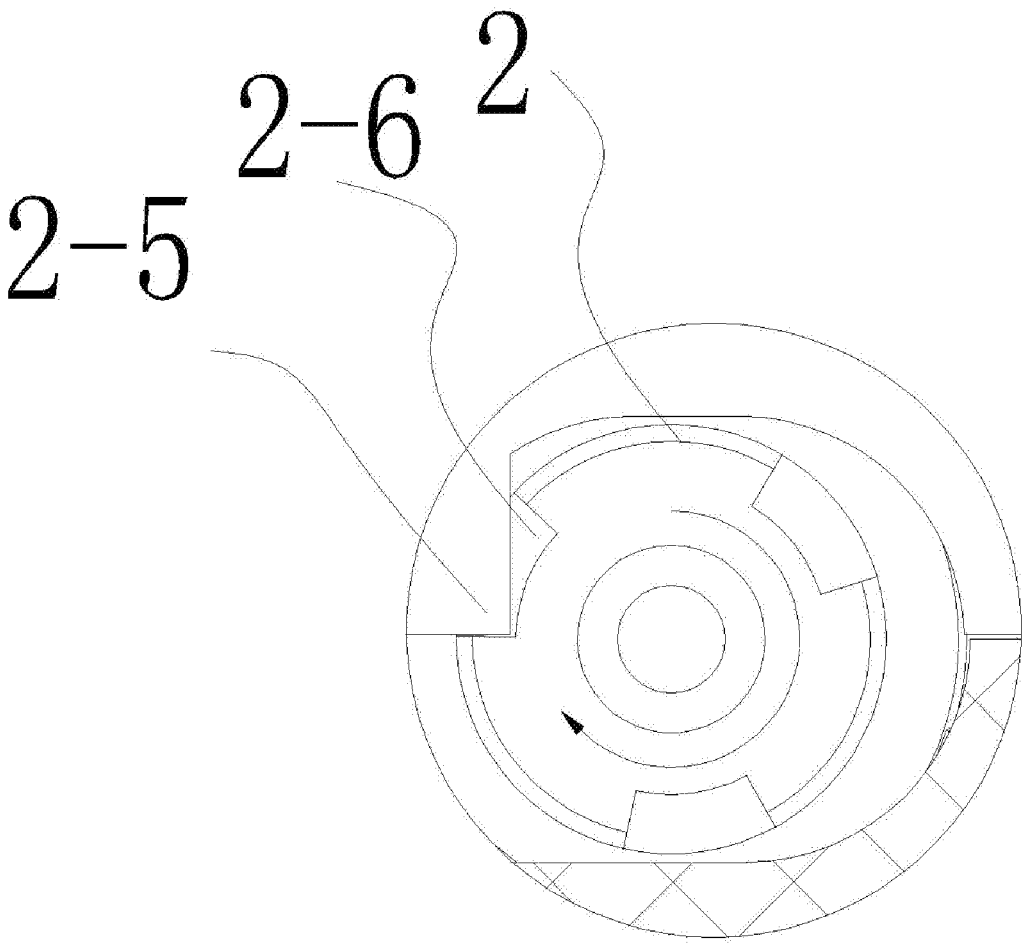
FIG. 12 is a partially enlarged view of the portion B shown in FIG. 9 (second status).

Referring to FIG. 11 and FIG. 12, The locking mechanism described in this embodiment comprises a convex body 2-5, a concave body 2-6, the convex body 2-5 and the concave body 2-6 are respectively disposed on the case 1 and the sweeping roller 2, and when the sweeping roller 2 moves to the front end of the stroke space 2-4, the convex body 2-5 is embedded in the concave body 2-6 to prevent the sweeping roller 2 from rotating, when the locking mechanism prevents the sweeping roller 2 from rotating, the sweeping strip 22 rotates to the garbage entry position.

The convex body 2-5 described in this embodiment is disposed in case 1, and the concave body 2-6 is disposed in the rotating shaft 21 or the rolling wheel 23. Preferably, the concave body 2-6 is disposed on the rolling shaft 231 of the rolling wheel 23.

The foregoing descriptions are merely exemplary embodiments of the present invention, but not intended to limit the present invention in any form. Although the present invention is disclosed by preferred embodiments, it is not intended to limit the present invention. Technicians skilled in the art can make some changes or modifications made equivalent to the technical contents disclosed herein without departing from the technical solution of the present invention. All technical contents without departing from the technical solution of the present invention, and any simple modifications, equivalent changes and modifications made to the above embodiments will fall within the scope of the protection of the present invention.

What is claimed is:

1. A cleaning tool, comprising:

a hand-push sweeper including a case, the case comprising a garbage storage space with an opening for receiving the garbage;

a push rod, the push rod is rotatably connected with the case;

a sweeping roller rotating within the case as to sweep garbage into the garbage storage space when the sweeping roller rotates; and a mop plate that is removably connected to the case of the hand-push sweeper by a removable connection means, wherein, when the mop plate is connected to the hand-push sweeper, the mop plate disengages the sweeping roller from the ground; when the mop plate is separated from the hand-push sweeper, the sweeping roller is in contact with the ground, wherein the cleaning tool further comprises an adjustment mechanism that inclines the opening of the case upwards when the push rod is tilted, and wherein the push rod is flexibly connected with the case, and the adjustment mechanism is disposed at a pivotal connection between the push rod and the case.

2. The cleaning tool according to claim 1, wherein the removable connection means comprises a vertical connecting mechanism and a horizontal connection structure, the case and the mop plate are limited by the horizontal connection structure in front and back, left and right; and the case is vertically movably assembled with the mop plate by the vertical connecting mechanism.

3. The cleaning tool according to claim 2, wherein the vertical connecting mechanism comprises a magnet, and the case and the mop plate are magnetized by the magnet.

4. The cleaning tool according to claim 2, wherein the vertical connecting mechanism comprises a hook and a corresponding card slot.

5. The cleaning tool according to claim 2, wherein the vertical connecting mechanism comprises an elastic operation member and a buckle.

6. The cleaning tool according to claim 2, wherein the vertical connecting mechanism comprises a convex portion disposed on the case, a concave portion disposed on the mop plate, and the convex portion is embedded in the concave portion to assemble removably the hand-push sweeper with the mop plate.

7. The cleaning tool according to claim 6, wherein the convex portion is in interference fit with the concave portion.

8. The cleaning tool according to claim 2, wherein the horizontal connection structure comprises a recessed position disposed on the mop plate, and the case is disposed in the recessed position.

9. The cleaning tool according to claim 8, wherein the case is in interference fit with the recessed position on the mop plate.

10. The cleaning tool according to claim 2 wherein the horizontal connection structure comprises a protruding position disposed on the mop plate, a hole disposed at the bottom of the case, and the protruding position is embedded in the hole when the hand-push sweeper is connected to the mop plate.

11. The cleaning tool according to claim 1, wherein the adjustment mechanism is a torsion spring, the push rod is rotationally connected with the case using a universal joint, and the universal joint comprises an upper joint, a lower joint, and one end of the upper joint is rotatably connected with one end of the lower joint, and the other end of the lower joint is rotatably connected with the case, another end of the upper joint is fixedly installed with the push rod; one end of the torsion spring exerts force on the case, and the other end of the torsion spring exerts force on the lower joint.

12. The cleaning tool according to claim 1, further comprising a latching mechanism for preventing the sweeping roller from reversing, the latching mechanism comprises the sweeping roller, wherein the sweeping roller has a movable stroke space after being set in a mounting portion; a locking mechanism disposed between the sweeping roller and a machine body of the case, when the sweeper sweeps forward, the sweeping roller moves to a rear end of the stroke space; when the sweeper retreats, the sweeping roller moves to a front end of the stroke space, the locking mechanism prevents the sweeping roller from rotating.

13. The cleaning tool according to claim 12, wherein the sweeping roller comprises a rotating shaft, and the rotating shaft comprises a sweeping strip.

14. The cleaning tool according to claim 12, wherein the locking mechanism comprises a convex body, a concave body, the convex body and the concave body are respectively disposed on the case and the sweeping roller, and when the sweeping roller moves to the front end of the stroke space, the convex body is embedded in the concave body to prevent the sweeping roller from rotating.

15. The cleaning tool according to claim 12, wherein the sweeping roller rotates to a garbage entry position when the locking mechanism prevents the sweeping roller from rotating.

16. The cleaning tool according to claim 12, wherein the locking mechanism comprises a convex body, a concave body, the convex body and the concave body are respectively disposed on the case and the sweeping roller, and when the sweeping roller moves to the front end of the stroke space, the convex body is embedded in the concave body to prevent the sweeping roller from rotating, when the locking mechanism prevents the sweeping roller from rotating, the sweeping roller rotates to a garbage entry position.

17. The cleaning tool according to claim 1, wherein the mop plate has front side and back side, and the front side of the mop plate is configured for connecting with a mop cloth.

18. The cleaning tool according to claim 1, further comprising a shovel blade including a flexible scraper and a mounting base, and the flexible scraper is fixed with the mounting base, the mounting base being connected with the case, and the flexible scraper forms an obtuse angle with the ground on a forward side of the case.

* * * * *